US007256549B1

(12) United States Patent
Michael et al.

(10) Patent No.: US 7,256,549 B1
(45) Date of Patent: Aug. 14, 2007

(54) THREE ELECTRODE ARC-DISCHARGE LAMP

(75) Inventors: Donald L. Michael, Corvallis, OR (US); Matthew Beasley, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 11/276,675

(22) Filed: Mar. 9, 2006

(51) Int. Cl.
*H05B 39/04* (2006.01)

(52) U.S. Cl. ..... 315/107; 315/106; 315/46; 315/94; 315/309

(58) Field of Classification Search ..... 315/46, 315/48, 49, 50, 94, 309, 96–107, 112–118
See application file for complete search history.

(56) References Cited

U.S. PATENT DOCUMENTS 3,403,293 A * 9/1968 Michelsen ..... 315/168
3,634,718 A 1/1972 Larson
3,982,154 A 9/1976 Mize et al.
4,013,922 A * 3/1977 VAN DER Meulen ..... 315/362
4,207,499 A 6/1980 Tam et al.
4,321,501 A 3/1982 English et al.
4,692,664 A 9/1987 Lim
4,992,703 A * 2/1991 Ramaiah ..... 315/261
6,008,587 A 12/1999 Mills
6,288,491 B1 * 9/2001 Ramaiah et al. ..... 315/52
6,798,139 B2 * 9/2004 Ramaiah et al. ..... 313/634

* cited by examiner

*Primary Examiner*—Tuyet Vo
(74) *Attorney, Agent, or Firm*—Timothy F. Myers

(57) ABSTRACT

A method of operating an arc discharge lamp that has first and second electrodes is described. First, the first electrode is heated with a third electrode with a first arc until the first electrode temperature is sufficiently elevated to allow for thermionic emission. Then, a first voltage is applied between the first and second electrode at a voltage less than 1000 volts to create a second arc.

17 Claims, 7 Drawing Sheets

THREE ELECTRODE ARC-DISCHARGE LAMP

BACKGROUND

Conventional projectors use a high-pressure arc lamp to create a light source having a small "fireball" located within a gap between a set of anode and cathode electrodes. The electrodes are generally enclosed within a fill gas, such as mercury or xenon (or any noble gas). One conventional method for starting the high-pressure arc lamp to create the fireball is to provide a high voltage potential between the anode and cathode. When the potential applied between the anode and cathode is sufficient to initiate gas breakdown, gas ions and electrons are liberated from the fill gas. The flow of electrons and ions between the anode and cathode initiates an arc discharge. This initial arc discharge requires a very high voltage, usually in the tens of thousands of volts. When the electrons and gas ions are liberated, the ions under go a rapid acceleration towards the cathode. When the ions collide with the cathode, sputtering damage occurs which erodes the cathode, increasing the gap between the anode and cathode. This increased gap lessens the usable life of the high-pressure arc lamp. The need to create the initial high voltage for the initial arc discharge also may reduce the life of the ballast or lamp and increases the complexity of the projector system design. Accordingly, an improved lamp design that reduces the requirement for an initial very high voltage is desired in that it would have increased lifetimes and lower system complexity.

BRIEF DESCRIPTION OF THE DRAWINGS

The invention is better understood with reference to the following drawings. The elements of the drawings are not necessarily to scale relative to each other. Rather, emphasis has instead been placed upon clearly illustrating the invention. Furthermore, like reference numerals designate corresponding similar though not identical parts through the several views.

DETAILED DESCRIPTION

Figure 1:
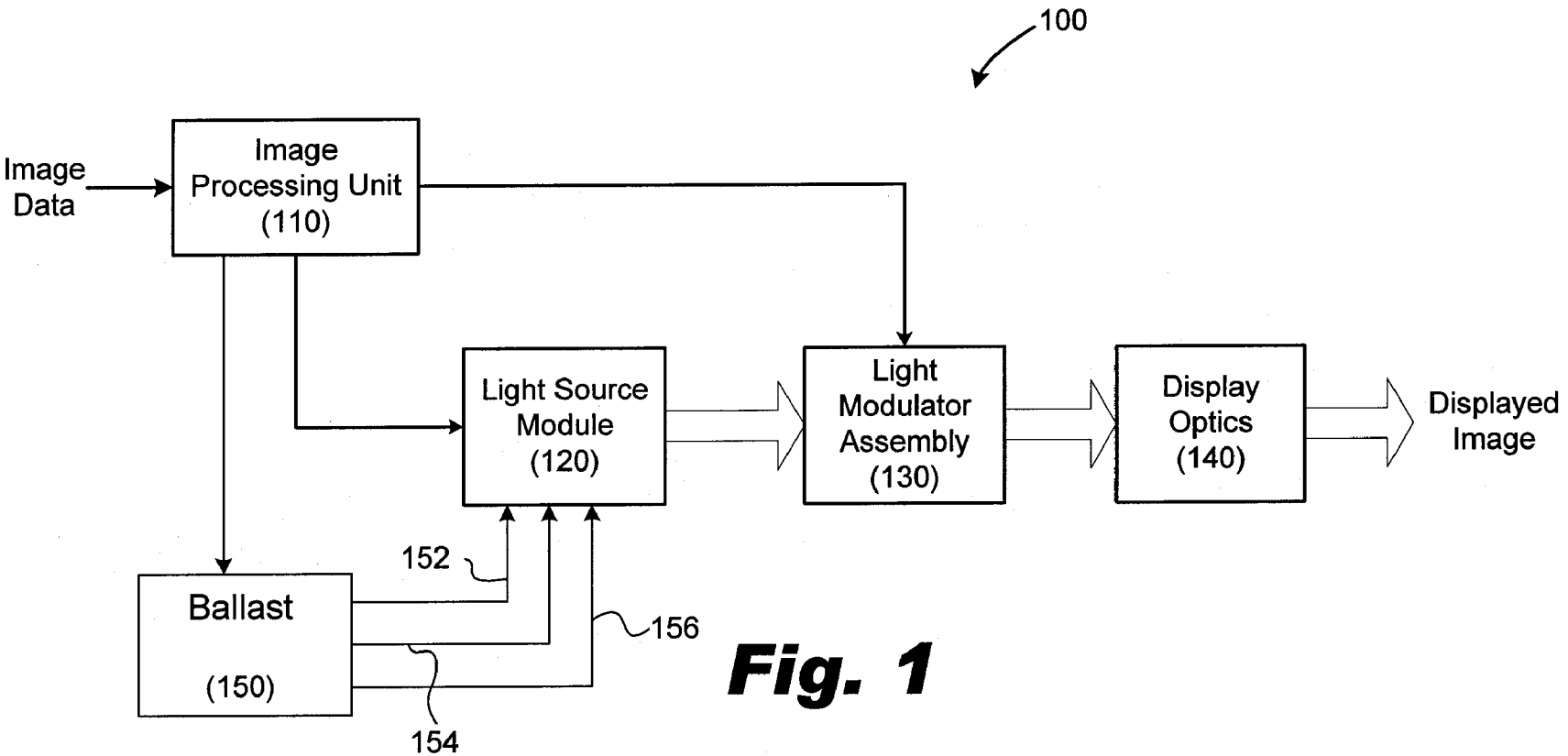
FIG. 1 is an exemplary block diagram of a projection system that includes an embodiment of the invention.

In order to increase the life of arc discharge lamps, the arc discharge lamp electrode structure and method in which the lamp arc is initiated is changed. An auxiliary electrode is included in the lamp and placed in close proximity to the main cathode. The auxiliary electrode and main cathode are used to create a first initial arc, which is used to heat the main cathode to a point in which thermionic emission of electrons from the main cathode to the main anode occur. Accordingly, the auxiliary electrode is used as a cathode relative to the main cathode (which is temporarily used as an anode) to prevent sputtering damage to the main cathode. When sufficient thermionic electrons flow between the main cathode and the anode, the main arc is initiated at a much lower voltage than when done conventionally.

Thus, the main cathode is heated with the initial arc from the auxiliary electrode until the main cathode reaches a temperature sufficient for thermionic emission. At a sufficiently elevated temperature, the electron emission from the main cathode to the main anode can be initiated at a significantly reduced voltage. This cathode heating technique is unique because of the striking and maintenance of the first initial arc on the main cathode. This first initial arc is reversed in polarity (compared to the main arc) such that the main cathode is treated like an anode for a short period. The bombardment of electrons from the auxiliary electrode to the main cathode quickly heats the main cathode, and once heated sufficiently, the main arc is initiated with a significantly smaller voltage.

By locating the auxiliary electrode adjacent to the side of the main cathode and having the auxiliary gap be less than the main gap distance, a lower voltage can be used to strike the auxiliary gap than that required conventionally to strike the main gap without the new electrode structure. The use of the smaller auxiliary gap is what allows for the lower striking voltage of the auxiliary gap and subsequently the main gap. This change improves the lifetimes of the auxiliary electrode and consequently the main cathode by this new technique. In other words, by striking the auxiliary arc on the side of the main cathode, damage to the tip of the main cathode is significantly reduced during the lamp startup.

Several advantages besides the reduction of sputtering damage and increased life also occur due to this new technique. For instance, by striking and maintaining the initial arc on the side of the main cathode to heat it, the initiation of the main arc strike voltage is reduce by a factor of at least 10 or a 100 times or more, while the initiation of the auxiliary arc strike voltage may be reduced by at least half. By having a lower main arc strike voltage, the cost and size of the ballast used to control the lamp is reduced. These reductions occur due to the elimination of the need for the auxiliary ignition transformer to carry the main lamp current. That is, the auxiliary ignition transformer can have less winding due to the lower strike voltage due to the shorter gap distance; the wire does not need to be as thick to carry the main bulb current, as the auxiliary arc will be shut off after ignition of the main arc by another ignition transformer. The main ignition transformer can have significantly less windings due to the significantly reduced ignition voltage due to the thermionic electron flow. Since this main ignition transformer carries the lamp current, because there is less winding, the coil wire can be thicker allowing for decreased resistance and better efficiency, or the transformer can be made smaller to reduce size and cost. Finally, the reduced strike voltages increases reliability by reducing the dielectric stress on the insulation of the ignition transformers and accordingly allow for less breakdown usually caused by the prior higher voltages. Accordingly, the designer of a ballast circuit can trade off more design parameters as needed to fit a particular application than with the conventional arc discharge lamp architecture.

The following description provides more detail on particular embodiments for carrying out how to make and use the invention. While several different embodiments are described, those of skill in the art will appreciate that several different modifications may be made. While the drawings are not necessarily to scale and omit other elements that may be included in an actual design, the drawings have been simplified for the sake of clarity and ease of discussion of the invention over that of the prior art.

FIG. 1 is a block diagram of a projection system 100 that incorporates at least one embodiment of the invention. An image-processing unit 110 receives image data, in static or video form. Image processing unit 110 presents the image data in appropriate format to a light modulator assembly 130. A light source module 120 that may be controlled by the image-processing unit 110 or user illuminates the light modulator assembly 130. The light modulator assembly 130 spatially and temporally modulates the light over an area to form one or more images from the image data received from the image-processing unit 110. The modulated light from the light modulator assembly 130 is projected by display optics 140 to form a displayed image, such as with a projection screen, a television screen or monitor, or directly viewed, just to name a few.

Exemplary image processing units 110 are microprocessor and/or logic circuits connected to computer readable memory used to scale, de-interlace, interpolate, decimate, downsample, sharpen, color shift, morph, resample, or change the frame rate of the image data. The image-processing unit 110 can perform appropriate digital signal processing on the image data as desired for a particular application. Exemplary light modulator assembly 110 units include digital light processors, other micro-mirror devices, liquid crystal displays, liquid crystal on silicon displays, interference based modulators, diffraction based modulators, or any other modulators that vary the intensity, frequency, color, angle, phase, or other characteristic of the light from light source module 120. Exemplary display optics 140 includes front, rear, short throw, or anamorphic projections, and direct view designs just to name a few. The display optics 140 may include optical elements of a reflective, refractive, holographic, diffractive, freznel, pixelated, or combinations thereof, nature. Exemplary light source modules 120 include ultra high-pressure mercury arc lamps and xenon arc lamps.

The light source module 120 is powered by a ballast circuit 150 to provide the initial striking and operating voltages and currents. For the improved arc bulb in the light source module 120, a first voltage 152 is supplied to main cathode, a second voltage 154 is applied to the main anode, and a third voltage 156 is supplied to the auxiliary electrode.

Figure 2:
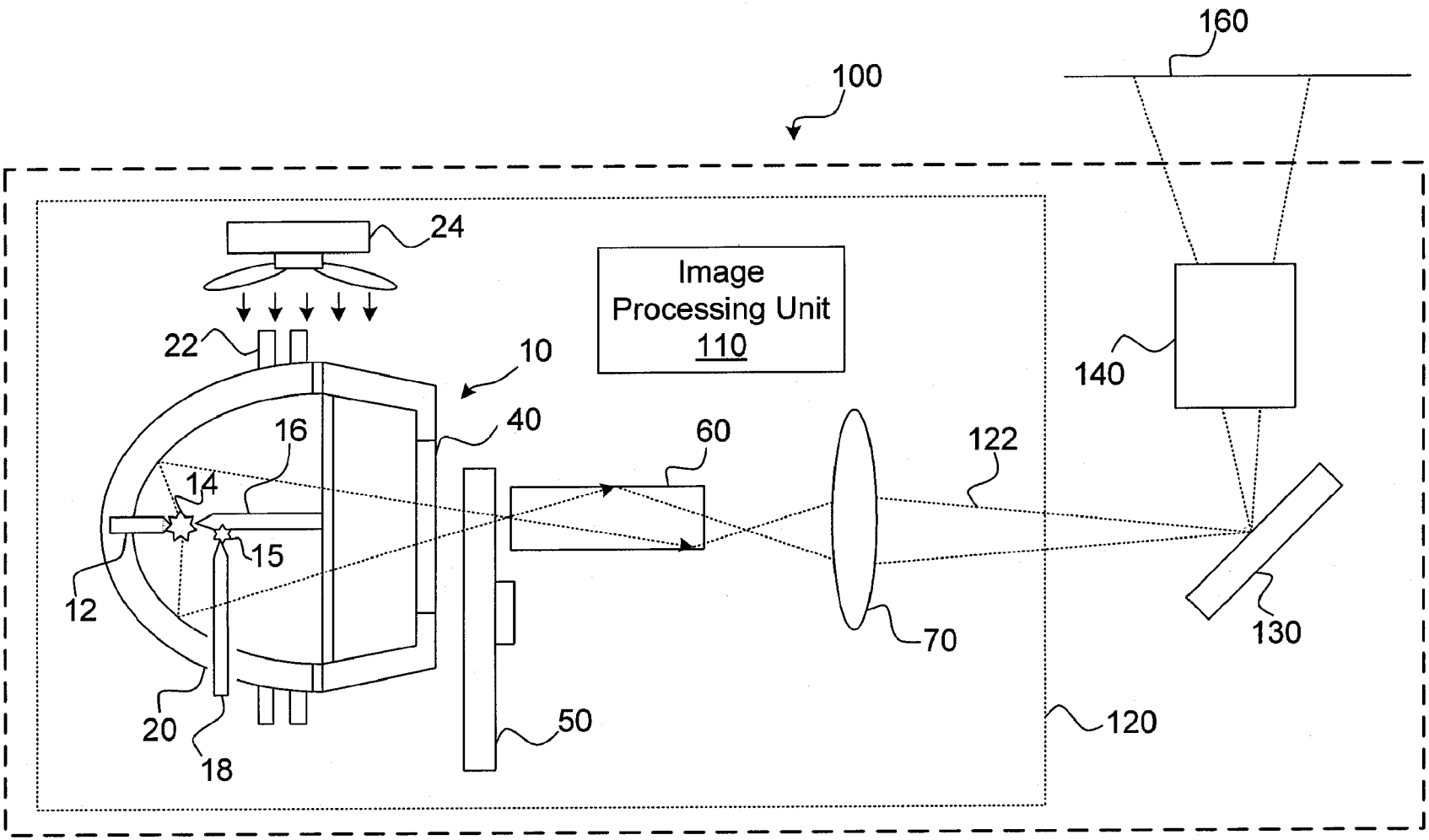
FIG. 2 is an exemplary schematical block diagram of a projection system that illustrates a light source module that includes an embodiment of the invention.

FIG. 2 is an exemplary schematical view of a projection system 100 with more detail of light source module 120 for one exemplary embodiment. Light 122 from the light source module 120 is directed onto the light modulator assembly 130 through display optics 140 onto a viewing surface 160. The light source module 120 includes a bulb or enclosure such as a high-pressure light source (HPLS) 10, a gamut generator such as color wheel 50, a spatial homogenizer such as integrating rod 60, and a condenser lens 70 for directing the light 122 onto the light modulator assembly 130. In this embodiment, the HPLS 10 includes a body 20 with heat dissipation elements 22 that are cooled with airflow from a fan 24. The HPLS 10 includes a first electrode, the main cathode 16, a second electrode, the main anode 12 and a third electrode, the auxiliary electrode 18 (alternatively, the auxiliary cathode). The first, second, and third electrodes are arranged within the body 20 of the HPLS 10 to allow for forming a first or auxiliary fireball 15, and a second or main fireball 14. The auxiliary fireball 15 is formed within the gap between the auxiliary electrode 18 and the main cathode 16. The second fireball 14 is formed within the gap between the main cathode 16 and the main anode 12. Light 122 generated by the main fireball 14 is reflected from a partial elliptical surface (in this example but could be parabolic or other surface shape) on body 20 and through a window 40 and, if required, color wheel 50 to the integrating rod 60. The window 40 may be a simple quartz, sapphire, or glass window and alternatively may include a filtering function to block or reflect UV and/or IR light.

Figure 3:
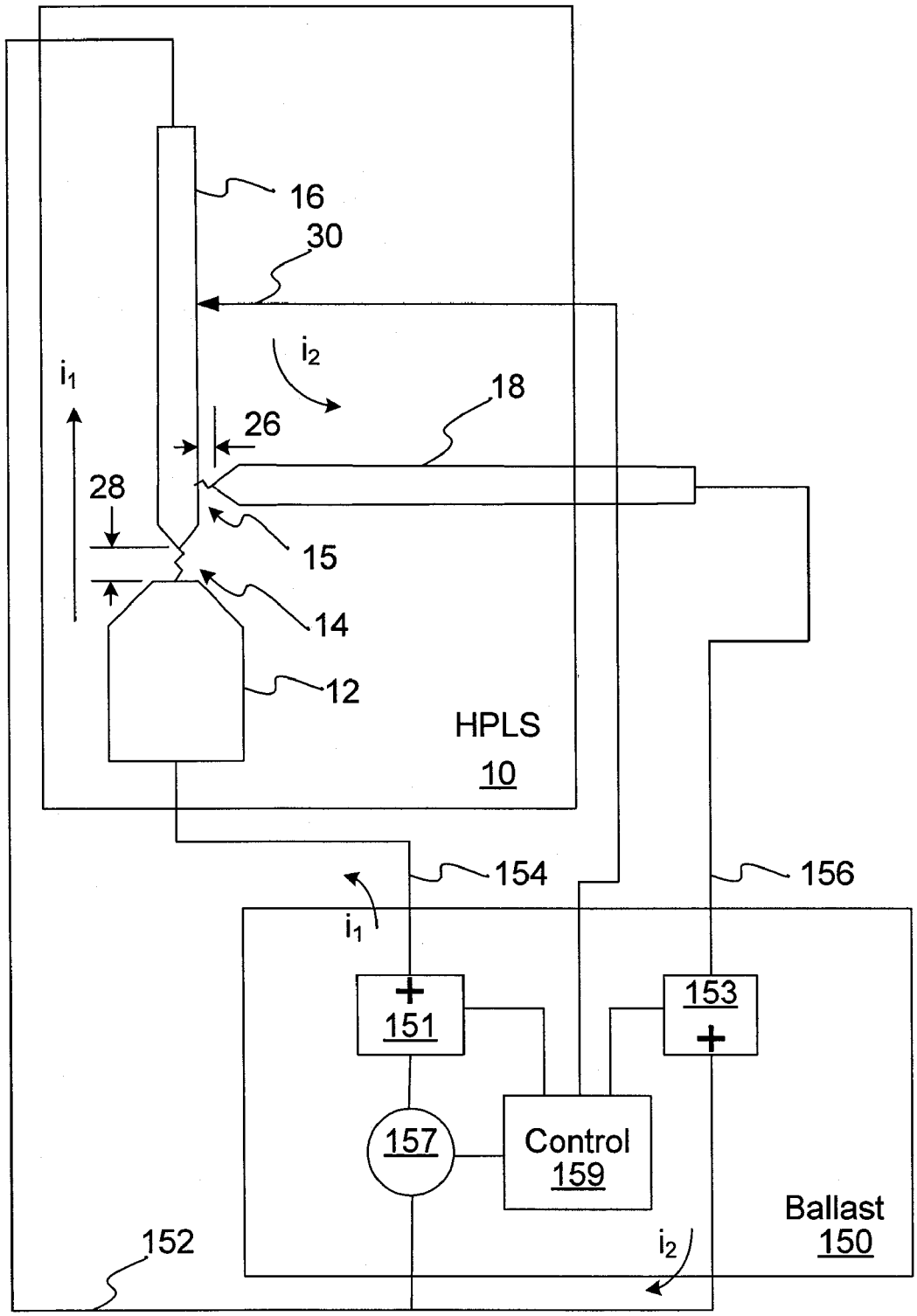
FIG. 3 is an exemplary schematic of the electrode structure and ballast circuit in one embodiment of the invention.

FIG. 3 is a magnified view of an exemplary electrode structure within the HPLS 10 and an exemplary ballast circuit 150. The ballast circuit 150 includes a first ignition transformer 153 and a second ignition transformer 151. Those of skill in the art will appreciate the first and second ignition transformers 151 and 153 may be implemented as a single igniter. A logic circuit and/or microcontroller in control circuit 159 control the two ignition transformers. In one embodiment, the control circuit 159 may also be able to monitor the current $i_1$ in the loop of the main cathode 16 and main anode 12. In another embodiment, the control circuit 159 may be able to monitor the temperature of the main cathode with a temperature sensor 30. The ballast 150 may include additional components and sensors that are not shown for clarity.

In the embodiment shown in FIG. 3, there are two main current loops, $i_1$ and $i_2$. The first current loop, $i_1$, is that current which flows from the second ignition transformer 151 through the main anode 12, through the main gap 28, main cathode 16 and current sensor 157 back to the second ignition transformer 151. The second current loop, $i_2$, flows from the first ignition transformer 153 to the main cathode 16, through the auxiliary gap 26 to the auxiliary electrode 18 back to the first ignition transformer 153. Currents $i_1$ and $i_2$ are shown as conventionally positive flowing currents, e.g. opposite the flow of electrons in the circuit.

Therefore, the first ignition transformer has a positive output coupled to the main cathode, thereby making it an anode, and a negative output coupled to the auxiliary electrode, thereby making it a cathode. For this specification, a "cathode" is a negatively charged electrode that is the source of electrons in an electrical device. Similarly, an "anode" is a positively charged electrode by which electrons are collected in an electrical device. Therefore, electrons flow from the auxiliary electrode 18 to the main cathode 16 (acting as an anode) when the first ignition transformer is activated. Thus, the gaseous ions (positively charged) created by the liberation of the electrons from the gas atoms, are accelerated to the auxiliary electrode 18 (negatively charged) rather than the main cathode 16 (which is relatively positively charged).

As the auxiliary arc 15 is used to heat the main cathode 16, thermionic electrons are sourced by the main cathode 16 through the gap 28 to the main anode 12. The control circuit 159 may sense the amount of current $i_1$ flowing within current sensor 157 and if it is sufficient, as predetermined, the control circuit may activate the second ignition transformer 151 to create the main arc 14 or fireball. Alternatively, the control circuit 159 may use the temperature sensor 30 to detect the temperature of the main cathode 16 as it is being heated by the auxiliary arc 15, and when the temperature is sufficient (e.g. determined previously that at that temperature sufficient thermionic electrons are emitted) then the control circuit 159 may activate the second ignition transformer 151. When the control circuit 159 activates the second ignition transformer 151, electrons are sourced from the main cathode 16 through the main gap 28 to the main anode 12. Alternatively, the control circuit may use a predetermined amount of time based on characterization of a design for determining when the temperature of the main cathode is sufficient to strike the main arc 14.

Figure 4:
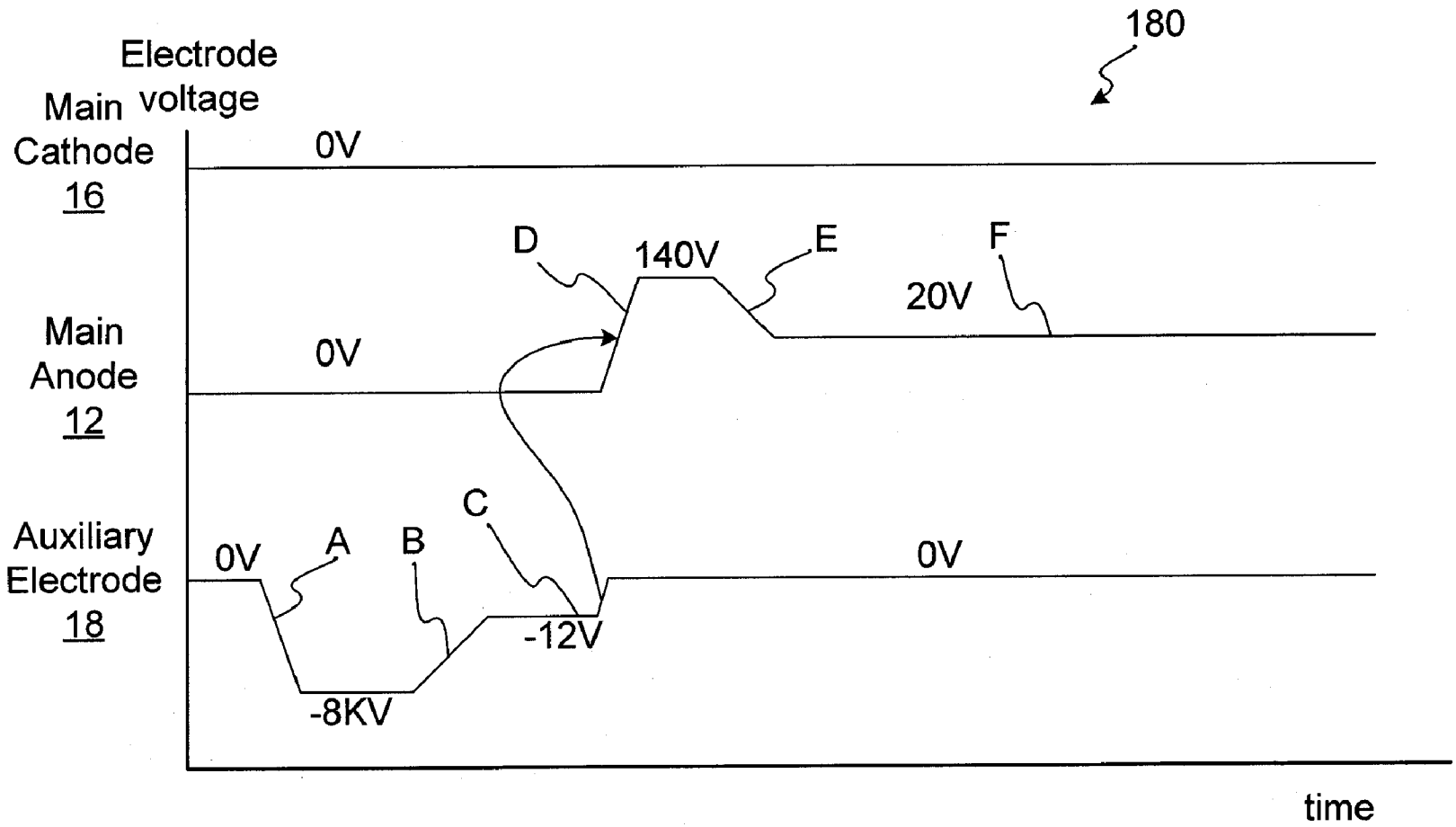
FIG. 4 is an exemplary timing diagram illustrating the ballast's control of electrode voltages in the embodiment of FIG. 3.

FIG. 4 is an exemplary timing diagram 180 that illustrates the voltage levels (not to scale) on the three electrodes in one embodiment of sequencing the ignition of the main arc 14. In this particular embodiment, the main cathode is set to a 0 (zero) volt potential (such as ground) as a reference with respect to the auxiliary electrode and main anode voltages. The auxiliary electrode 18 is first held at 0 Volts by the control circuit 159 before the decision is made to begin the start up sequence at point A. At point A, the control circuit 159 sets the potential between the main cathode 16 and the auxiliary electrode 18 at 8 kVolts (kV), with the auxiliary electrode being the more negative, thus allowing it to act as the cathode since it will source electrons. This 8 kV potential causes the electrons in the gaseous mixture within the HPLS 10 to be liberated from the gas atoms to create the gaseous ions. After the initial ignition, at point B, the voltage applied by the first ignition transformer is reduced to a sustaining operating level such as −12 Volts.

When the gaseous ions and electrons recombine, light is created in the form of photons. This light generation occurs within or near the auxiliary gap 26 to form the auxiliary fireball 15. The surrounding gas converts energy that is not released as photons into heat and this heated gas in contact with the main cathode 16 causes its temperature to rise.

As the main cathode 16 temperature rises, electrons from the tip of the electrode are thermionicly emitted into the main gap 28 and collected by the main anode 12. When the main cathode is detected sufficiently elevated in temperature at point C, either by sense of the current flow in current sensor 157, time, or by temperature sensor 30. The control circuit 159 then activates the second ignition transformer at point D to apply a 140 Volt voltage (for example) between the main cathode 18 and the main anode 12. After the main arc 14 is ignited, at point E, the second ignition transformer applies a sustaining voltage of 20 V across the main gap 28. Finally at point F, the control circuit 159 causes the first ignition transformer to shut off or supply a 0 V voltage (the same as the main cathode 16 voltage) to the auxiliary electrode 18 to cause the auxiliary fireball 15 to extinguish.

Figure 5:
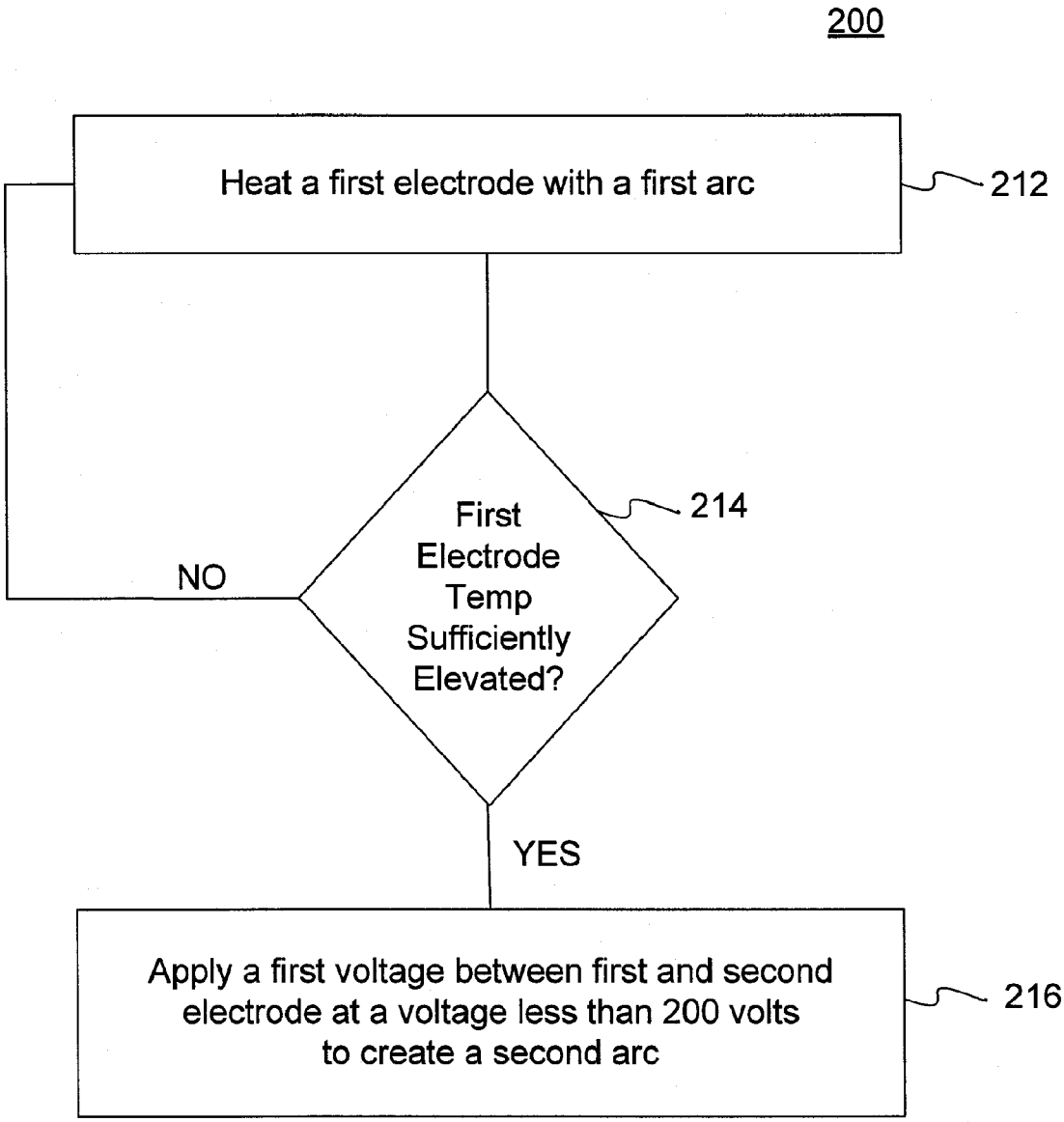
FIG. 5 is an exemplary flow chart of one embodiment of a method for controlling the electrodes.

FIG. 5 is an exemplary flowchart 200 of a method of operating the modified arc discharge lamp. The basic idea, at block 212, is to heat a first electrode, the main cathode 16, with a first arc, the auxiliary arc 15 (FIG. 2) produced by the auxiliary electrode 18 (FIG. 2) and the main cathode 16. This heating causes the first electrode to create thermionic electrons to flow within the main gap 28, helping to reduce the voltage needed to activate the main arc 14. In decision block 214, the first electrode is checked to determine if its temperature is elevated sufficiently (or timed from prior characterization) to allow for the ignition of the main arc 15. As stated earlier, this can be done by monitoring the current flow through the main gap 28 or by sensing the temperature of the main cathode 16. If not, the main cathode 16 is continued to be heated by the first arc. If so, then a first voltage is applied between the first and second electrodes (the main cathode and main anode, respectively) at a voltage of less than 1000 volts, for example 200 volts, to create a second arc, the main arc or fireball 14. Accordingly, the heating of the first electrode occurs due to electrons flowing from a third electrode, the auxiliary electrode 18 to the first electrode. In addition, the creation of the second arc occurs from electrons flowing from the first electrode to the second electrode. The first electrode and second electrode are separated by a first distance, and the first electrode and the third electrode are separated by a second distance that is less than the first distance. This reduction of the gap distance allows for a lower initial arc strike voltage that further reduces the amount of damage to the first electrode, the main cathode 16. The heating of the first electrode includes a first circuit having a first current, and the applying of a first voltage between the first and second electrode includes supplying a second current. The second current does not flow within the first current. This separation of currents allows a first ignition transformer to be designed to handle less current allowing for a reduction in cost and/or size. This described method of operating the modified arc discharge lamp allows lowering of the first voltage to ignite the main arc by greater than 100 times less than the first voltage previously required to ignite the main arc if the auxiliary arc was not used. This major reduction in strike voltage allows a second ignition transformer to be used that requires less turns and possibly thicker wire to improve efficiently, lessen cost and reduce the size of the ballast circuit. The modified arc discharge lamp allows for several different design, cost, size trade-offs to be made by designers of lighting and projection systems.

Alternative Method of Operating Lamp

Adding the auxiliary electrode 18 to a high pressure arc lamp would normally require providing a separate high voltage feed into the high pressure gas chamber of the arc lamp. This may require additional cost and complexity in that there may be a need to isolate the auxiliary electrode circuit from the main electrode circuit due to their being at different high voltage potentials. One alternative method of operating the lamp is to take advantage of the "diode" nature of the main and auxiliary arc gaps.

In the high-pressure arc gaps, no current flows until there is sufficient break down voltage across the gap and an arc jumps from the cathode to the anode. The breakdown voltage is determined by the geometry and the work function of the cathode. The lower the work function of the cathode, the lower the voltage required to initiate an arc and flow current. The work function is primarily a property of the cathode material; however, the structure of the material and geometry may significantly change the breakdown voltage required.

Since the arc will initiate from the negative charged electrode toward the positively charged electrode, switching the polarity of the charge switches the role of each electrode. This in turn changes which electrode will emit electrons and initiate the arc. If the two electrodes have a different work function, then the breakdown voltage required to emit the electrons occurs at different voltage thresholds given the different materials, material structure, and geometry difference between the gap electrodes. When different work functions exist between the cathode and anode, switching the polarity will change the breakdown voltage between the electrodes forming the gap. This difference in breakdown voltages is what creates the "diode" nature of the gap and this "diode" nature of the gap is what is exploited to allow for a simple two lead configuration to be used.

Figure 6:
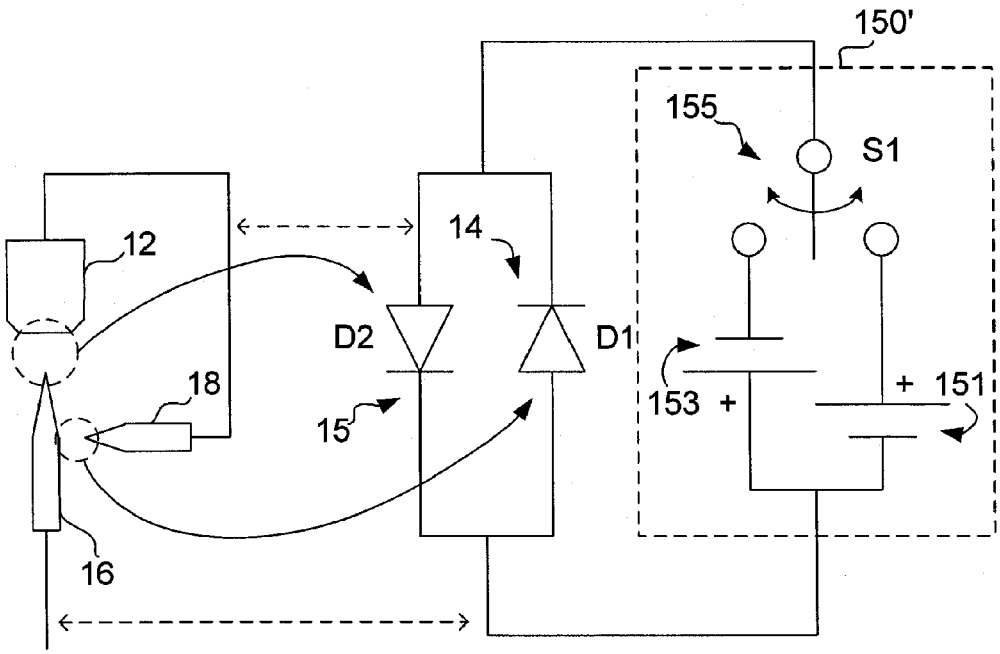
FIG. 6 is an exemplary schematic of an alternative embodiment of the invention.

FIG. 6 is an exemplary schematic of an alternative arrangement for wiring the auxiliary electrode 18 and main electrode 18 to an alternative ballast 150'. The alternative ballast 150' includes first ignition transformer 153, second ignition transformer 151, and switch 155. Those of skill in the art will appreciate that alternative ballast 150' may alternatively have one ignition transformer that is designed to switch polarities. The auxiliary gap 15 is represented by first diode D1 and the main gap 14 is represented by second diode D2. The cathode of D1 and anode of D2 are connected to the switch 155, while the anode of D1 and the cathode of D2 are connected to the positive output of first ignition transformer 153 and the negative output of second transformer 151. Since the main gap cathode 16 is also the auxiliary gap anode, this connection between the cathode of D2 and the anode of D1 is inherent in the arc lamp to form one lead of the lamp 10. The second lead of the lamp 10 is made by the connection of the auxiliary electrode (the auxiliary cathode) to the main gap anode.

To operate this new configuration, the main gap anode 12 is electrically connected to the auxiliary gap cathode 18 to form one lead, typically through the lamp housing 20 without insulating the aux. gap cathode 18 from the housing (see FIG. 2). The other lead is attached to the main gap cathode 16. The auxiliary gap cathode 18 to anode (main gap cathode 16) breakdown voltage is made less than the main gap anode 12 to main gap cathode 16 breakdown voltage (reversed bias). Further, the main gap cathode 16 to main gap anode 12 breakdown voltage (forward bias), when the main gap cathode 16 is heated, is made less than the breakdown voltage of the reversed biased auxiliary gap electrodes (18 and 16). Thus, when the auxiliary gap, when forward biased, has a breakdown voltage of a first polarity applied to the two leads, there is no current flow between the main anode 12 and main cathode 16. However, once the main cathode 16 is sufficiently heated, the polarity of the voltage applied to the two lamp leads are reversed and the main gap cathode to anode breakdown (now in forward bias) is sufficient to form the main arc while the auxiliary arc is extinguished due to the resulting increase in its reverse bias breakdown voltage. Thus, switching between the auxiliary arc 15 to the main arc 16 is accomplished with a simple polarity change of the ballast circuit 150'.

Figure 7:
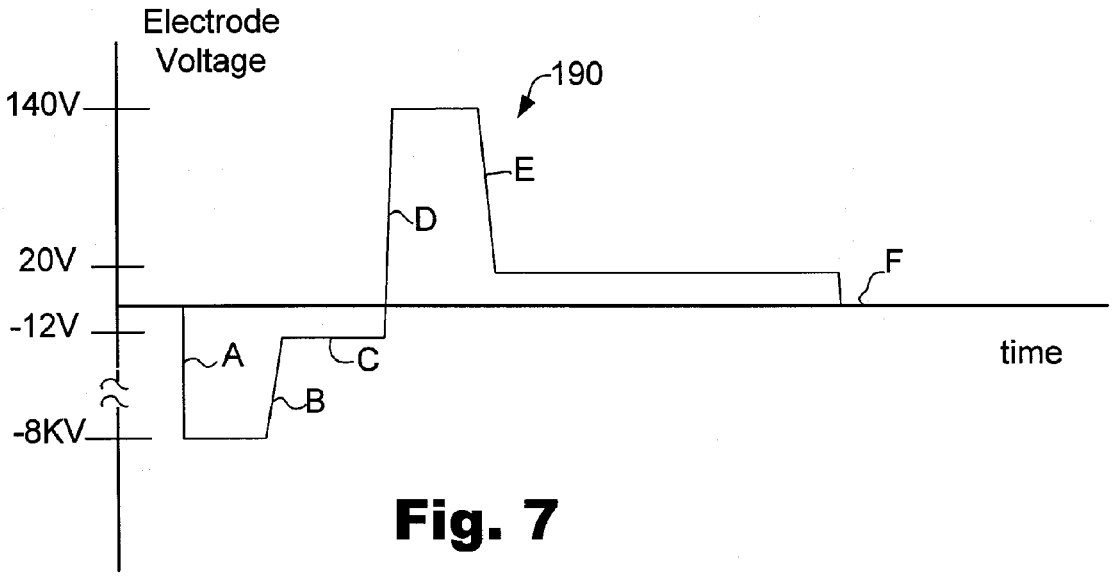
FIG. 7 is an exemplary timing diagram illustrating ballast's control of electrode voltages in the embodiment of FIG. 6.

FIG. 7 is an exemplary timing diagram 190 for the alternative circuit shown in FIG. 6. The vertical axis illustrates the electrode voltage (not to scale) applied to the two lamp leads, the horizontal axis illustrates time progressing from left to right. At point A, the leads are supplied a voltage of −8 KV which forward biases diode D1 of the auxiliary gap and reverse biases diode D2 of the main gap. At point B after the auxiliary fireball is started, the applied voltage is dropped to −12 V to maintain the auxiliary fireball 15 at point C. This applied voltage causes the auxiliary fireball 15 heat the main cathode 16. After it is determined that the main cathode 16 is heated sufficiently (such as by time, temperature, or current), at point D, the applied voltage from the ballast 150' is switched by switch S1 155 (or otherwise equivalently) to 140 V which now forward biases diode D2 of the main gap, while reverse biasing the diode D1 of the auxiliary gap. This applied voltage causes the main fireball 14 to ignite and at point E, the applied voltage is reduced to about 20 V to maintain the main fireball 14 until point F when the applied voltage is shut off or supplied at 0 V to cause the main fireball to extinguish.

Design of the main cathode is an important factor to consider. A number of materials and material structures with very low work functions and high melting temperatures cannot generally be used in arc lamps due to thermal shock during the conventional striking of the main arc. This thermal shock during conventional striking causes the material to crack and shatter thereby rendering it useless. However, by having an auxiliary arc cathode heater as disclosed herein, these materials may be used. For instance, single crystal materials can be preheated with the auxiliary arc before striking the main arc to reduce the thermal shock.

Also, proper design of the main cathode with respect to the auxiliary electrode to form the auxiliary arc can improve the diode properties and protect the main cathode 16 from damage when the auxiliary arc is used to strike the side of the main cathode 16. Additionally, it may be desirable to have the auxiliary fireball 15 structures to stay within the shadow of the main cathode to prevent the main cathodes light from being obscured by the auxiliary structure. Accordingly, a good design of the auxiliary arc heater may incorporate main cathode damage protection, shadow management, and provision for a large reverse bias voltage threshold.

FIGS. 8A-8D illustrate several exemplary and non-exclusive design alternatives for the auxiliary arc heater electrode design with respect to the main cathode 16. These designs can incorporate composite multi-piece structures or be integral to the main cathode material.

Figure 8A:
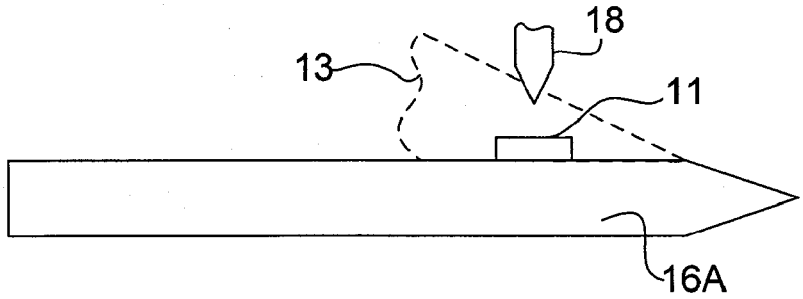
FIGS. 8A-8D are exemplary cathode features and designs which may be used in various embodiments of the invention.

FIG. 8A is an exemplary integrated raised anode design. In this example, the main cathode 16A which is the anode of the auxiliary arc structure incorporates an integral anode stand-off 11 that may be machined from the main cathode material. The anode stand-off 11 is located within the main cathode 16A tip shadow 13 and opposite the auxiliary cathode 18.

Figure 8B:
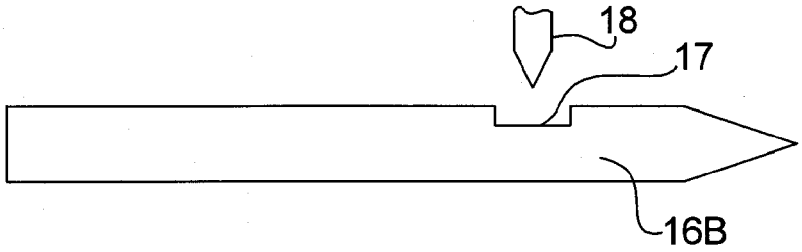

FIG. 8B is an exemplary integrated machined flat anode design. In this embodiment, the main cathode 16B has a flat surface machined into the round main cathode electrode.

Figure 8C:
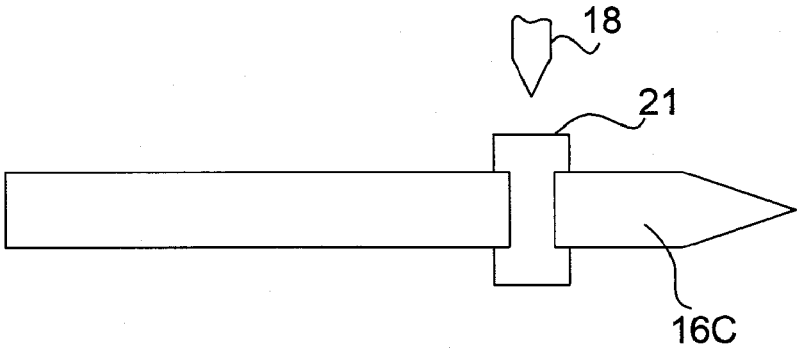

FIG. 8C is an exemplary multi-component high reverse bias threshold design. In this embodiment, the main cathode 16C is formed of multiple components of which the auxiliary anode 21 is a separate component that may be of the same or different material than the main cathode tip and aft support. This design allows the auxiliary anode material to change so it may have a different work function from the main cathode tip. This approach allows the auxiliary anode 21 to have a higher reverse voltage bias threshold thereby allowing for a lower cost ballast control circuit.

Figure 8D:
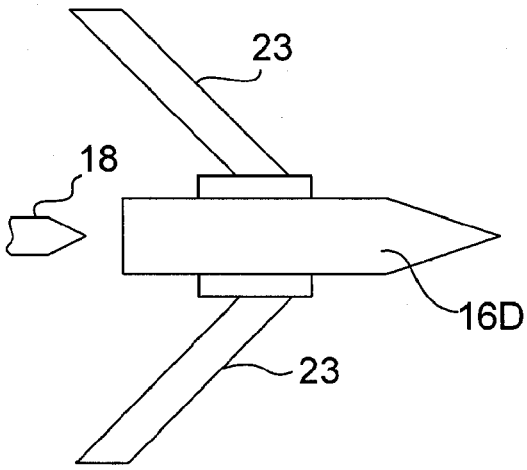

FIG. 8D is an exemplary extension of an AP Tech Vogel mount design that incorporates an auxiliary arc heater. The main cathode 16D is supported by Vogel mount members 23 to suspend it within the bulb structure. Auxiliary cathode 18 is positioned near the back of the main cathode 16D, which provides the anode for auxiliary arc heater. This approach allows the auxiliary fireball 15 to be maintained within the shadow of the cathode tip to maximize the lumens of the lamp 10. Further, the multi-component design allows the work function of the anode to be significantly different from the main cathode by allowing the back of the main cathode to be coated or formed with different materials, such as single crystal materials, such as zirconium and hafnium for example just to name a couple. This extension of the Vogel mount design also improves assembly tolerances by allowing the auxiliary cathode 18 to rest between the Vogel mounts 23. Depending on the actual design, electrical insulating material may be required around the Vogel mounts 23 to prevent unwanted arcing between the auxiliary cathode 18 and the Vogel mounts 23.

Those of skill in the art will recognize that several different electrode structures can be alternatively designed to incorporate the integral or multi-component features shown and still fall within the scope and spirit of the invention.

Empirical Results

Testing of sample units illustrate the effectiveness of the new arc ignition technique. The main gap strike voltage was reduced from 19000 Volts to 140 Volts. This reduction of the strike voltage is less than 100 times that previously. The steady state voltage required to maintain the main arc remained the same at 20 Volts, as would be expected since the main gap size and gas composition remain unchanged. The auxiliary gap strike voltage only required 8000 Volts due to the reduced gap size. This new strike voltage is less than 10,000 Volts and less than one-half the main gap strike voltage without the heating from the auxiliary arc. The auxiliary steady state voltage required to maintain the auxiliary arc was only 12 Volts, which is consistent with the reduced gap distance reducing the impedance of the electron flow through the gaseous mixture. These results are those of just one trial, several different modifications can be made to improve or alter the results as desired. Several different process improvements can be made to reduce the gap of the auxiliary electrode from the main cathode that can result in much further reduction is the auxiliary ignition voltage.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

This invention claimed is:

1. An arc discharge lamp, comprising:

an assembly enclosing an ionizable medium;

a first, second, and third electrodes sealed within the assembly, the first electrode separated from the second electrode by a first distance, the first electrode separated from the third electrode by a second distance less than the first distance;

a ballast circuit configured to use the first electrode as an anode and the third anode as a cathode to initiate a first arc at a first voltage, and configured to use the first electrode as a cathode and the second electrode as an anode to initiate a second arc with a second voltage after the first arc is initiated, wherein the second voltage is less than 1000 volts and the first voltage is less than 10,000 volts; and a temperature sensor thermally coupled to the first electrode and wherein the second voltage is not applied until the temperature sensor detects a predetermined temperature of the first electrode.

2. The arc discharge lamp of claim 1, wherein the second electrode is electrically coupled to the third electrode.

3. The arc discharge lamp of claim 1, wherein the first electrode is formed of a multi-component structure wherein a work-function between the first electrode and the third electrode is different than the work function between the first electrode and the second electrode.

4. The arc discharge lamp of claim 1, wherein the first voltage is less than one-half a fourth voltage, wherein the fourth voltage is an amount of voltage to initiate an arc between the first electrode and the second electrode if the third electrode is not used.

5. An arc discharge lamp, comprising:

an assembly enclosing an ionizable medium;

a first, second, and third electrodes sealed within the assembly, the first electrode separated from the second electrode by a first distance, the first electrode separated from the third electrode by a second distance less than the first distance; and a ballast circuit configured to use the first electrode as an anode and the third anode as a cathode to initiate a first arc at a first voltage, and configured to use the first electrode as a cathode and the second electrode as an anode to initiate a second arc with a second voltage after the first arc is initiated, wherein the second voltage is less than 1000 volts and the first voltage is less than 10,000 volts wherein the ballast circuit further includes an ignition transformer connected to the third electrode and wherein a current required to maintain the arc between the first electrode and the second electrode does not flow in the ignition transformer.

6. An arc discharge lamp, comprising:

an assembly enclosing an ionizable medium;

a first, second, and third electrodes sealed within the assembly, the first electrode separated from the second electrode by a first distance, the first electrode separated from the third electrode by a second distance less than the first distance and wherein the first electrode has an aft portion and a tip portion and is suspended bV Vogel mount members and the third electrode is positioned near the aft portion of the first member; and a ballast circuit configured to use the first electrode as an anode and the third anode as a cathode to initiate a first arc at a first voltage, and configured to bombard electrons from the third electrode to the first electrode causing the first electrode to heat until a second arc is initiated at a second voltage between the first electrode and the second electrode.

7. The arc discharge lamp of claim 6, wherein the second electrode is electrically coupled to the third electrode.

8. The arc discharge lamp of claim 6, the first electrode is formed of a multi-component structure wherein a work-function between the first electrode and the third electrode is different than the work function between the first electrode and the second electrode.

9. The arc discharge lamp of claim 6, wherein the first voltage is less than one-half a fourth voltage, wherein the fourth voltage is the amount of voltage to initiate an arc between the first electrode and the second electrode if the third electrode is not used.

10. An arc discharge lamp, comprising:

an assembly enclosing an ionizable medium;

a first, second, and third electrodes sealed within the assembly, the first electrode separated from the second electrode by a first distance, the first electrode separated from the third electrode by a second distance less than the first distance; and a ballast circuit configured to use the first electrode as an anode and the third anode as a cathode to initiate a first arc at a first voltage, and configured to bombard electrons from the third electrode to the first electrode causing the first electrode to heat until a second arc is initiated at a second voltage between the first electrode and the second electrode and wherein the ballast circuit further includes an ignition transformer connected to the third electrode and wherein a current required to maintain the arc between the first electrode and the second electrode does not flow in the ignition transformer.

11. A method of operating an arc discharge lamp having first and second electrodes, comprising:

heating the first electrode with a third electrode with a first arc until the first electrode temperature is sufficiently elevated to allow for thermionic emission; and applying a first voltage between the first and second electrode at a voltage less than 1000 volts to create a second arc;

wherein heating the first electrode includes a first circuit having a first current, and wherein the applying of a first voltage between the first and second electrode includes supplying a second current and wherein the second current does not flow within the first current.

12. The method of claim 11, wherein the first arc is initiated with a second voltage that is less than 1000 volts.

13. The method of claim 11, wherein the heating of the first electrode occurs due to electrons flowing from the third electrode to the first electrode.

14. The method of claim 11, wherein the creation of the second arc occurs from electrons flowing from the first electrode to the second electrode.

15. The method of claim 11, wherein the first electrode and second electrode are separated by a first distance, and the first electrode and the third electrode are separated by a second distance less than the first distance.

16. The method of claim 11, wherein heating the first electrode includes a second circuit having a second current, and wherein the method further includes sensing the second current for a predetermined level before the applying of the first voltage between the first and second electrode.

17. The method of claim 11, further comprising stopping the first arc after the second arc has been initiated.

* * * * *

UNITED STATES PATENT AND TRADEMARK OFFICE

CERTIFICATE OF CORRECTION

PATENT NO. : 7,256,549 B1
APPLICATION NO. : 11/276675
DATED : August 14, 2007
INVENTOR(S) : Donald L. Michael et al.

It is certified that error appears in the above-identified patent and that said Letters Patent is hereby corrected as shown below:

In column 10, line 26, in Claim 6, delete “bV” and insert -- by --, therefor.

Signed and Sealed this

Fifth Day of May, 2009

JOHN DOLL
*Acting Director of the United States Patent and Trademark Office*